US006613120B2

(12) United States Patent
Ando et al.

(10) Patent No.: US 6,613,120 B2
(45) Date of Patent: Sep. 2, 2003

(54) HARD PARTICLES, WEAR RESISTANT IRON-BASED SINTERED ALLOY, METHOD OF PRODUCING WEAR RESISTANT IRON-BASED SINTERED ALLOY, VALVE SEAT, AND CYLINDER HEAD

(75) Inventors: Kimihiko Ando, Toyota (JP); Akira Manabe, Aichi-ken (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/734,926

(22) Filed: Dec. 13, 2000

(65) Prior Publication Data

US 2001/0018852 A1 Sep. 6, 2001

(30) Foreign Application Priority Data

Dec. 17, 1999 (JP) ..... 11-359022

(51) Int. Cl.[7] ..... B22F 3/12

(52) U.S. Cl. ..... 75/246; 419/11; 419/38; 428/546

(58) Field of Search ..... 75/246; 419/11, 419/38; 428/546

(56) References Cited

U.S. PATENT DOCUMENTS

| | | | | |
|---|---|---|---|---|
| 4,332,616 A | * | 6/1982 | Morishita et al. | 75/243 |
| 5,858,056 A | * | 1/1999 | Fujine et al. | 75/236 |
| 5,859,376 A | * | 1/1999 | Ishibashi et al. | 75/243 |

FOREIGN PATENT DOCUMENTS

| | | |
|---|---|---|
| EP | 0 010 545 | 5/1980 |
| EP | 0 339 436 | 11/1999 |
| GB | 1 269 407 | 4/1972 |
| GB | 2 334 725 | 9/1999 |
| JP | 53-112206 A | 9/1978 |
| JP | 4-157138 A | 5/1992 |
| JP | 6-92627 B2 | 11/1994 |
| JP | 9-242516 A | 9/1997 |

* cited by examiner

*Primary Examiner*—Ngoclan Mai
(74) *Attorney, Agent, or Firm*—Burns, Doane, Swecker & Mathis, LLP

(57) ABSTRACT

Hard particles are provided containing 20 to 70% of Mo, 0.5 to 3% of C, 5 to 40% of Ni, 1 to 20% of Mn, a balance in Fe, and impurities, where % represents percentage by mass, and may further contain at least one of 40% or less of Co, 0.1 to 10% of Cr, and 4% or less of Si. A wear resistant iron-based sintered alloy contains 4 to 30% of Mo, 0.2 to 3% of C, 1 to 20% of Ni, 0.5 to 12% of Mn, a balance in Fe, and impurities, with respect to the total mass of the iron-based sintered alloy as represented by 100%. In the sintered alloy, the base contains 0.2 to 5% of C, 0.1 to 12% of Mn, a balance in Fe, and impurities, with respect to the total mass of the base, and the hard particles contain 20 to 70% of Mo, 0.5 to 3% of C, 5 to 40% of Ni, 1 to 20% of Mn, a balance in Fe, and impurities, with respect to the total mass of the hard particles. The hard particles are dispersed in the base with an area ratio of 0.10 to 0.60. A method to produce a wear resistant sintered alloy of the above composition is also provided.

39 Claims, 5 Drawing Sheets

HARD PARTICLES, WEAR RESISTANT IRON-BASED SINTERED ALLOY, METHOD OF PRODUCING WEAR RESISTANT IRON-BASED SINTERED ALLOY, VALVE SEAT, AND CYLINDER HEAD

INCORPORATION BY REFERENCE

The disclosure of Japanese Patent Application No. HEI 11-359022 filed on Dec. 17, 1999 including the specification, drawings and abstract is incorporated herein by reference in its entirety.

BACKGROUND OF THE INVENTION

1. Field of the Invention

The present invention relates to hard particles, a wear resistant iron-based sintered alloy, and a method of producing the alloy. The invention further relates to a valve seat formed from the sintered alloy, and a cylinder head including a valve seat or valve seats formed from the sintered alloy. The valve seat is suitably used in a gas engine using LPG, CNG, or like gas as a fuel.

2. State of the Art

In the discussion of the state of the art that follows, reference is made to certain structures and/or methods. However, the following references should not be construed as an admission that these structures and/or methods constitute prior art. Applicant expressly reserves the right to demonstrate that such structures and/or methods do not qualify as prior art against the present invention.

Laid-Open Patent Publication (Kokai) No. SHO 53-112206 of Japanese Patent Application (published in 1978) discloses, as a wear resistant sintered alloy for use in forming a valve seat or the like, a sintered alloy obtained by forming a green compact from a mixed powder. The mixed powder is obtained by mixing a parent material having a composition of a low-alloy steel or a stainless steel with 5–40% of a powder of hard particles, and then sintering the green compact at 1050–1250° C. The hard particles have a composition of 0.10% or less of Carbon (C), 0.5–10% of Silicon (Si), 0.40% or less of Manganese (Mn), and 10–50% of Molybdenum (Mo), as basic elements, and a total of 40% of at least one element selected from Nickel (Ni), Chromium (Cr) and Cobalt (Co), and a balance consisting of Iron (Fe).

In the aforementioned sintered alloy, the amount of Mn contained in the hard particle is relatively small, that is, 0.40% or less.

Additionally, in order to ensure improved durability of a sintered alloy, it is preferable to provide increased strength of adhesion between the hard particles and the base or parent material. However, in the aforementioned sintered alloy the adhesion strength between the hard particles and the base is not sufficiently high, and can be further improved.

SUMMARY OF THE INVENTION

The invention was developed in the light of the above-mentioned circumstances. It is therefore an object of the invention to provide hard particles, a wear resistant iron-based sintered alloy, a method of producing a wear resistant iron-based sintered alloy, and a valve seat, which assure increased adhesion strength between the hard particles and the base, a sufficiently high density of the sintered alloy, and a good solid lubrication property due to the use of Mo.

The hard particles have a composition of 20 to 70% of Mo, 0.5 to 3% of C, 5 to 40% of Ni, 1 to 20% of Mn, a balance of Fe, and impurities (mass %). The particle may also comprises 40% or less of Co.

Alternatively, a hard particle may have a composition of 20 to 60% of Mo, 0.2 to 3% of C, 5 to 40% of Ni, 1 to 15% of Mn, 0.1 to 10% of Cr, a balance of Fe, and impurities (mass %). The particle may also comprise at least one of 40% or less of Co and 4% or less of Si.

A wear-resistant iron-based sintered alloy has two components: a base and a plurality of particles. The base has the composition 0.2 to 5% of C, 0.1 to 12% of Mn, a balance of Fe, and impurities (mass % of the base) and the hard particles, dispersed in the base with an area ratio of 10 to 60%, have the composition 20 to 70% of Mo, 0.5 to 3% of C, 5 to 40% of Ni, 1 to 20% of Mn, a balance of Fe, and impurities (mass % of the particles). After sintering, the alloy has the composition 4 to 30% of Mo, 0.2 to 3% of C, 1 to 20% of Ni, 0.5 to 12% of Mn, a balance of Fe, and impurities (mass % of the alloy).

Similarly, an alternative wear-resistant iron-based sintered alloy has two components: a base and a plurality of particles. The base has the composition 0.2 to 5% of C, 0.1 to 10% of Mn, a balance of Fe, and impurities (mass % of the base)and the hard particles, dispersed in the base with an area ratio of 10 to 60%, 20 to 60% of Mo, 0.2 to 3% of C, 5 to 40% of Ni, 1 to 15% of Mn, 0.1 to 10% of Cr, a balance of Fe, and impurities (mass % of the particles). After sintering, the alloy has the composition 4 to 30% of Mo, 0.2 to 3% of C, 1 to 20% of Ni, 0.5 to 9% of Mn, 0.05 to 5% of Cr, a balance of Fe, and impurities (mass % of the alloy).

A method is provided whereby powders of the alloys and hard particles of the present invention are mixed (with a small amount of carbon), compacted, and sintered into wear resistant alloys.

BRIEF DESCRIPTION OF THE DRAWING FIGURES

The objects and advantages of the invention will become apparent from the following detailed description of preferred embodiments thereof in connection with the accompanying drawings in which like numerals designate like elements and in which.

DETAILED DESCRIPTION OF PREFERRED EMBODIMENTS

Figure 1:
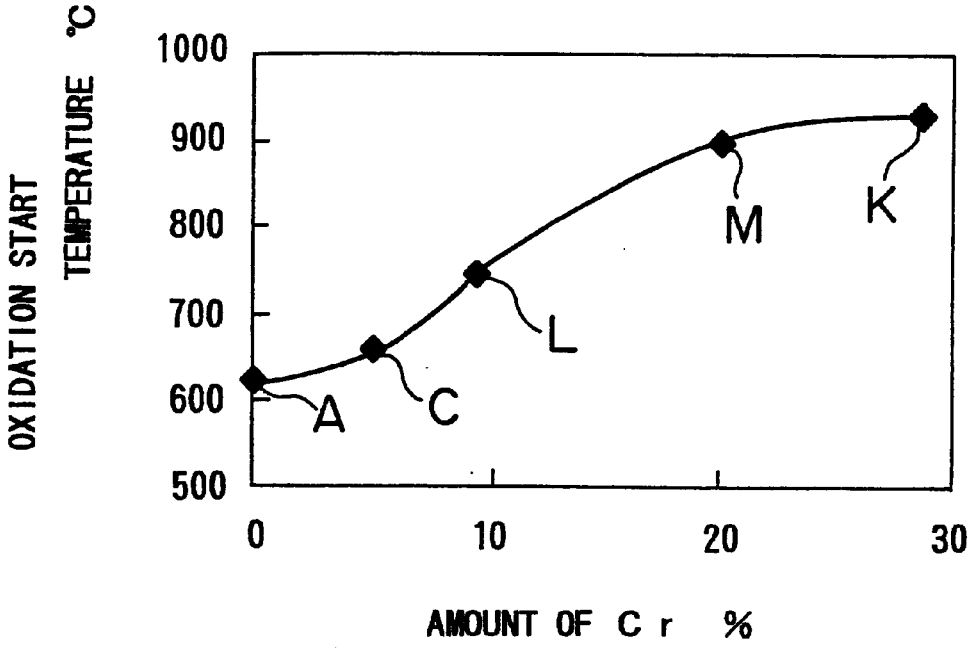
FIG. 1 is a graph indicating a relationship between the amount of Cr in a powder of hard particles and the oxidation start temperature of the hard particle powder.

As a result of intensive research and development on hard particles and wear resistant iron-based sintered alloys in which the hard particles are dispersed, the present inventors have gained the following findings (i) and (ii). Based on these findings, there have been developed hard particles, a wear resistant iron-based sintered alloy, and a method of producing the sintered alloy according to the present invention.

(i) If a wear resistant iron-based sintered alloy in which hard particles are dispersed is used in a heated region, the hard particles are more likely to form an oxide film when the particles contain Mo than when they contain Cr. The Mo oxide film is advantageous in that it has a solid lubrication property at a relatively low temperature. Particularly, it has been newly found that if the wear resistant iron-based sintered alloy is used under a relatively low temperature condition, and if hard particles, containing Mo and having a composition as indicated below in which the content of Cr is reduced or eliminated, are employed, a good solid lubrication property due to the oxide film formed on the surface of the hard particles can be favorably achieved, while assuring good wear resistance due to the hardness of the hard particles. Thus, the use of the hard particles as described below leads to further enhanced wear resistance of the sintered alloy.

(ii) Mn contained in the hard particles is more likely to diffuse into the base of the sintered alloy than Ni or Mo contained in the hard particles. Therefore, if hard particles having a composition including Mn as an active element as well as Mo and Ni as described below are employed, a sintered alloy in which the hard particles are dispersed has an increased amount of Mn diffused from the hard particles into the base. The diffused Mn provides a further increased adhesion strength at the interface between the hard particles and the base. Thus, the use of the above hard particles is advantageous in increasing the density and hardness of the wear resistant iron-based sintered alloy, which contributes to reducing the amount of wear on the sintered alloy.

According to the first aspect of the present invention, hard particles are provided which comprise 20–70% of Mo, 0.5–3% of C, 5–40% of Ni, 1–20% of Mn, and a balance including inevitable impurities and Fe, where % is based on mass. In the present specification, % means percentage by mass (mass %) unless otherwise specified. The hard particles according to the first aspect of the invention may further contain 40% or less, preferably 35% or less, of Co. In this case, the lower limit of the content of Co may be set to 10% or 20%.

According to the second aspect of the invention, hard particles are provided which contain 20–60% of Mo, 0.2–3% of C, 5–40% of Ni, 1–15% of Mn, 0.1–10% of Cr, and a balance including inevitable impurities and Fe, where % is based on mass. The hard particles according to the second aspect of the invention may further contain at least one of 40% or less, preferably 35% or less, of Co, and 4% or less, preferably 3% or less, of Si. In this case, the lower limit of the content of Co may be set to 10% or 20%, and the lower limit of the content of Si may be set to 0.1%, 0.5%, or 0.8%.

A wear resistant iron-based sintered alloy according to the third aspect of the invention contains 4–30% of Mo, 0.2–3% of C, 1–20% of Ni, 0.5–12% of Mn, and a balance including inevitable impurities and Fe, with respect to the total mass of the sintered alloy as represented by 100%. The base of the sintered alloy contains 0.2–5% of C, 0.1–12% of Mn, and a balance including inevitable impurities and Fe, with respect to the total mass of the base as represented by 100%, and the hard particles contain 20–70% of Mo, 0.5–3% of C, 5–40% of Ni, 1–20% of Mn, and a balance including inevitable impurities and Fe, with respect to the total mass of the hard particles as represented by 100%. Furthermore, in the wear resistant iron-based sintered alloy, the hard particles are dispersed in the base with an area ratio of 10–60%.

The wear resistant iron-based sintered alloy according to the third aspect of the invention as a whole may further include 24% or less, preferably 17% or less, of Co as a component thereof, and the hard particles may further contain 40% or less, preferably 30% or less, of Co as a component thereof. In this case, the lower limit of the mass % of Co with respect to the total mass of the sintered alloy may be set to 3%, 4.5%, or 9%, and the lower limit of the mass % of Co with respect to the total mass of the hard particles may be set to 10% or 20%.

A wear resistant iron-based sintered alloy according to the fourth aspect of the invention contains 4–30% of Mo, 0.2–3% of C, 1–20% of Ni, 0.5–9% of Mn, 0.05–5% of Cr, and a balance including inevitable impurities and Fe, with respect to the total mass of the sintered alloy as represented by 100%. The base of the sintered alloy contains 0.2–5% of C, 0.1–10% of Mn, and a balance including inevitable impurities and Fe, with respect to the total mass of the base as represented by 100%. The hard particles contain 20–60% of Mo, 0.2–3% of C, 5–40% of Ni, 1–15% of Mn, 0.1–10% of Cr, and a balance including inevitable impurities and Fe, with respect to the total mass of the hard particles as represented by 100%. Furthermore, in the wear resistant iron-based sintered alloy, the hard particles are dispersed in the base with an area ratio of 10–60%.

The sintered alloy according to the fourth aspect of the invention may further include at least one of 24% or less, preferably 17% or less, of Co and 2% or less, preferably 0.6% or less, of Si, with respect to the total mass of the alloy, and the hard particle composition may further include at least one of 40% or less, preferably 35% or less, of Co and 4% or less, preferably 3% or less, of Si with respect to the total mass of the hard particles. In this case, the lower limit of the mass % of Co with respect to the total mass of the sintered alloy may be set to 3%, 5%, or 10%, and the lower limit of the mass % of Si with respect to the total mass of the sintered alloy may be set to 0.04% or 0.15%. Further, the lower limit of the mass % of Co with respect to the total mass of the hard particles may be set to 10% or 20%, and the lower limit of the mass % of Si with respect to the total mass of the hard particles may be set to 0.1%, 0.5% or 0.8%.

According to the first and third aspects of the present invention as described above, the hard particles do not contain Cr as an active element, and therefore an oxide film of Mo is more likely to be formed on the surface of the hard particles. The Mo oxide film is able to function as a solid lubricating agent, so that the hard particles are sure to provide a solid lubrication property, as well as sufficient hardness and wear resistance.

As mentioned above, Cr is likely to form an oxide film, but the oxide film thus formed spreads or expands at a low rate. Therefore, once the oxide film of Cr is formed on a surface of the hard particles, further growth of the oxide film tends to be suppressed.

According to the second aspect of the invention and the fourth aspect of the invention as described above, the hard particles contain Cr as an active element in addition to Mo. The Cr is likely to form an oxide film that tends to suppress further oxide film growth on the surface of the hard particles. Thus, the oxide film formed on the surface of the hard particles of the second aspect of the invention and the sintered alloy of the fourth aspect of the invention are less likely to suffer from peeling-off due to excessive growth. Hence, the hard particles of the second aspect of the invention and the sintered alloy of the fourth aspect of the invention are suitable for use in a high-temperature environment in which oxidation readily progresses.

In the wear-resistant iron-based sintered alloy as described above, the value of α (the amount of Mn contained in the base of the sintered alloy)/(the amount of Mn contained in the hard particles dispersed in the base of the sintered alloy) may be within a selected one of the range of 0.05 to 1.0, the range of 0.10–0.8, and the range of 0.12–0.7 in terms of percentage by mass. Here, α means diffusion efficiency of Mn.

In the sintered alloy described above, a is defined in the above range, and a suitably controlled amount of Mn diffuses from the hard particles into the base of the sintered alloy, thus assuring increased adhesion strength between the hard particles and the base, and improved capability of retaining the hard particles in the base.

A method of producing a wear resistant iron-based sintered alloy according to the fifth aspect of the present invention includes the steps of: preparing a mixture by mixing 10–60% of a powder of the hard particles in accordance with the first or second aspect of the invention, 0.2–2% of a carbon powder, and a pure Fe powder or a low-alloy steel powder, and molding the mixture to form a green compact, and sintering the green compact to form a sintered alloy having a composition in accordance with the third or fourth aspect of the present invention.

The method of producing a sintered alloy according to the fifth aspect of the invention may assure improved capability of retaining the hard particles in the base, and improved density, hardness and wear resistance of the sintered alloy. Thus, the method makes it possible to produce a sintered alloy having a high durability.

According to the sixth aspect of the present invention, a valve seat is provided which is formed from the wear resistant iron-based sintered alloy according to the third or fourth aspect of the present invention.

The valve seat of the invention formed from the sintered alloy having the advantages as stated above exhibits sufficiently high durability, and thus contributes to improvements in the performance and durability of a gas engine using a compressed natural gas or a liquefied natural gas as a fuel.

According to the seventh aspect of the present invention, a cylinder head is provided which incorporates a valve seat or seats formed from the wear resistant iron-based sintered alloy according to the third or fourth aspect of the present invention.

Furthermore, according to each aspect of the invention, a sufficiently large amount of Mn is caused to diffuse from the hard particles into the base of the sintered alloy, and the resulting sintered alloy provides improved adhesion strength between the hard particles and the base. This leads to improved capability of retaining the hard particles in the base, increased density and hardness of the sintered alloy, and improved wear resistance of the sintered alloy.

Hard Particles

The hard particles according to the first aspect of the present invention are characterized by containing 20–70% of Mo, 0.5–3% of C, 5–40% of Ni, and 1–20% of Mn in terms of percentage by mass, and a balance essentially consisting of inevitable impurities and Fe. Cr tends to raise the oxidation start temperature of the hard particles. Therefore, with the hard particles of the first aspect of the invention being formed without containing Cr as an active element the hard particles may be able to form an oxide film at or above a relatively low temperature. Thus, the hard particles of the present invention can provide a sufficient solid lubrication property in relatively low temperature range and intermediate temperature range in a heated region.

In one form of the first aspect of the present invention, the hard particles may further include 40% by mass of Co in addition to the above-indicated elements, taking account of the resistance to thermal fatigue.

The hard particles according to the second aspect of the present invention are characterized by containing 20–60% of Mo, 0.2–3% of C, 5–40% of Ni, 1–15% of Mn, and 0.1–10% of Cr in terms of percentage by mass, and a balance consisting essentially of inevitable impurities and Fe.

The lower limits and upper limits set in conjunction with the composition of the hard particles according to each aspect of the invention may be suitably changed for various reasons that will be discussed later, and further changed depending upon the degree of importance of each characteristic, such as required hardness, required solid lubrication property, required adhesion strength, and required cost. Thus, the lower limit of the content of Mo may be set to 22%, 23%, or 25%, and the upper limit of Mo may be set to 40%, 45%, 50%, or 55%. With regard to C, the lower limit may be set to 0.3%, 0.5%, 0.6%, or 0.7%, and the upper limit may be set to 1.8% or 2.0%. With regard to Ni, the lower limit may be set to 7% or 9%, and the upper limit may be set to 20%, 22%, or 30%. With regard to Mn, the lower limit may be set to 1.5%, 2%, 3%, 4%, or 5%, and the upper limit may be set to 10%, 12%, 15%, or 18%.

Since Mo, contained in the hard particles, is likely to oxidize, the oxide film may be formed to an excessive extent depending on the conditions of use, for example, if the temperature in the environment of use is in a high temperature range. If the oxide film becomes excessive or redundant, the oxide film may peel off from the hard particles. Therefore, in the case where the oxide film tends to be excessively formed, Cr as well as Mo may be contained in the hard particles in a suitable amount within the range indicated above with respect to the second aspect of the invention. It is supposed that when Cr contained in the hard particles forms an oxide film, the Cr oxide film suppresses or restricts the growth of an oxide film on the hard particles.

Taking the above-described points into consideration, the hard particles in accordance with the first or second aspect of the invention may be in the form of any of (1-a) to (1-f) indicated below:

(1-a) hard particles having a composition (mass %) including 20–70% of Mo, 0.5–3% of C, 5–40% of Ni, and 1–20% of Mn, and a balance consisting essentially of inevitable impurities and Fe;

(1-b) hard particles having a composition (mass %) including 20–70% of Mo, 0.5–3% of C, 5–40% of Ni, 1–20% of Mn, and 40% or less of Co, and a balance consisting essentially of inevitable impurities and Fe;

(1-c) hard particles having a composition (mass %) including 20–60% of Mo, 0.2–3% of C, 5–40% of Ni, 1–15% of Mn, and 0.1–10% of Cr, and a balance consisting essentially of inevitable impurities and Fe;

(1-d) hard particles having a composition (mass %) including 20–60% of Mo, 0.2–3% of C, 5–40% of Ni, 1–15% of Mn, 0.1–10% of Cr, 4% or less of Si, and 40% or less of Co, and a balance consisting essentially of inevitable impurities and Fe;

(1-e) hard particles having a composition (mass %) including 20–60% of Mo, 0.2–3% of C, 5–40% of Ni, 1–15% of Mn, 0.1–10% of Cr, and 4% or less of Si, and a balance consisting essentially of inevitable impurities and Fe;

(1-f) hard particles having a composition (mass %) including 20–60% of Mo, 0.2–3% of C, 5–40% of Ni, 1–15% of Mn, 0.1–10% of Cr, and 40% or less of Co, and a balance consisting essentially of inevitable impurities and Fe.

The hard particles according to the first or second aspect of the present invention may be produced by an atomizing process in which a melt is sprayed, or produced by mechanically pulverizing a solidified body obtained by solidifying the melt. The above-mentioned atomization may be performed in a non-oxidizing atmosphere (i.e., an inert gas, such as nitrogen gas or argon gas, or under vacuum).

Oxidation Start Temperature of Hard Particles

The graph of FIG. 1 indicates a relationship between the amount of Cr contained in hard particles and the oxidation start temperature of the hard particles. On the basis of the characteristic indicated in FIG. 1, the oxidation start temperature of the hard particles can be shifted toward a lower temperature by reducing the amount of Cr. It follows that even where the ambient temperature during use is in a low temperature range or medium temperature range, an increased amount of an oxide film can be formed so as to accomplish the desired solid lubrication function of the hard particles. This is realized by reducing or eliminating the amount of Cr contained in the hard particles. Furthermore, if the ambient temperature during use is relatively high, and thus the amount of an oxide film formed on the hard particles tends to be excessively large, it is necessary to suppress or restrict the growth of the oxide film while assuring a required solid lubrication property. In this case, a small amount (10% or less, or, preferably, 8% or less) of Cr may be contained in the hard particles so as to suppress or restrict excessive growth of an oxide film.

Wear Resistant Iron-Based Sintered Alloy

A wear resistant iron-based sintered alloy according to the third aspect of the present invention has a composition including base components that consist of 0.2–5% of C, 0.1–12% of Mn, and a balance including inevitable impurities and Fe, with respect to the total mass of the base as represented by 100%. A wear-resistant iron-based sintered alloy according to the fourth aspect of the invention has a composition including base components that consist of 0.2–5% of C, 0.1–10% of Mn, and a balance including inevitable impurities and Fe, with respect to the total mass of the base as represented by 100%.

The base of the sintered alloy according to each aspect of the invention may contain Mo in an amount of, for example, 0–5%, and Ni in an amount of, for example, 0–5%, due to influences of elements diffused from the hard particles. Furthermore, the base of the sintered alloy according to each of the third and fourth aspects of the invention may contain Cr in an amount of, for example, 0–3%.

The composition of the base of the sintered alloy is limited or determined as indicated above, so as to ensure desired wear resistance of the iron-based sintered alloy and desired hardness of the base of the iron-based sintered alloy. In order to provide desired hardness, the base of the iron-based sintered alloy may employ a structure containing pearlite. The pearlite-containing structure may be a pearlite structure, a pearlite-austenite combined structure, a pearlite-ferrite combined structure, or a pearlite-cementite combined structure. In order to provide desired wear resistance, it is preferable to contain a small amount of ferrite in the base structure. The hardness of the base, which depends upon its composition, may be generally controlled to about Hv 120–300, or about Hv 150–250, but is not limited to these ranges. The hardness of the hard particles is higher than that of the base and may be generally controlled to about Hv 350–750 or about Hv 450–700, but is not limited to these ranges.

The Mn contained in the base of the sintered alloy is considered to have diffused from the hard particles during sintering. Where no amount of Mn is contained in a pure Fe powder or a low-alloy steel powder that constitutes the base of the sintered alloy, the value of $\alpha$ (the amount of Mn in the base of the sintered alloy/the amount of Mn in the hard particles dispersed in the base) can be controlled to about 0.05–1.0, or about 0.10–0.8, or about 0.12–0.7, in terms of percentage by mass, though $\alpha$ varies depending on the composition of the hard particles, the proportion of the hard particles in the sintered alloy, or the like.

In the sintered alloy, the hard particles are dispersed in the base with an area ratio of 10–60%. In this case, the lower limit of the area ratio of the hard particles may be set to 15% or 20%, and the upper limit thereof may be set to 55% or 50%, taking account of required wear resistance to be achieved.

Specifically, the wear resistant iron-based sintered alloys according to the third aspect and fourth aspect of the present invention may employ any one of the forms (2-a) to (2-f) as follows:

(2-a) a wear resistant iron-based sintered alloy which contains 4–30% of Mo, 0.2–3% of C, 1–20% of Ni, 0.5–12% of Mn, and a balance including inevitable impurities and Fe, with respect to the total mass of the sintered alloy as represented by 100%, wherein the base contains 0.2–5% of C, 0.1–12% of Mn, and a balance including inevitable impurities and Fe, with respect to the total mass of the base as represented by 100%, and the hard particles contain 20–70% of Mo, 0.5–3% of C, 5–40% of Ni, 1–20% of Mn, and a balance including inevitable impurities and Fe, with respect to the total mass of the hard particles as represented by 100%, and wherein the hard particles are dispersed in the base with an area ratio of 10–60%;

(2-b) a wear resistant iron-based sintered alloy which contains 4–30% of Mo, 0.2–3% of C, 1–20% of Ni, 0.5–12% of Mn, 24% or less of Co, and a balance including inevitable impurities and Fe, with respect to the total mass of the sintered alloy as represented by 100%, wherein the base contains 0.2–5% of C, 0.1–12% of Mn, and a balance including inevitable impurities and Fe, with respect to the total mass of the base as represented by 100%, and the hard particles contain 20–70% of Mo, 0.5–3% of C, 5–40% of Ni, 1–20% of Mn, 40% or less of Co, and a balance including inevitable impurities and Fe, with respect to the total mass of the hard particles as represented by 100%, and wherein the hard particles are dispersed in the base with an area ratio of 10–60%;

(2-c) a wear resistant iron-based sintered alloy which contains 4–30% of Mo, 0.2–3% of C, 1–20% of Ni, 0.5–9% of Mn, 0.05–5% of Cr, and a balance including inevitable impurities and Fe, with respect to the total mass of the sintered alloy as represented by 100%, wherein the base contains 0.2–5% of C, 0.1–10% of Mn, and a balance including inevitable impurities and Fe, with respect to the total mass of the base as represented by 100%, and the hard particles contain 20–60% of Mo, 0.2–3% of C, 5–40% of Ni, 1–15% of Mn, 0.1–10% of Cr, and a balance including inevitable impurities and Fe, with respect to the total mass of the hard particles as represented by 100%, and wherein the hard particles are dispersed in the base with an area ratio of 10–60%;

(2-d) a wear resistant iron-based sintered alloy which contains 4–30% of Mo, 0.2–3% of C, 1–20% of Ni, 0.5–9% of Mn, 0.05–5% of Cr, 2% or less of Si, 24% or less of Co, and a balance including inevitable impurities and Fe, with respect to the total mass of the sintered alloy as represented by 100%, wherein the base contains 0.2–5% of C, 0.1–10% of Mn, and a balance including inevitable impurities and Fe, with respect to the total mass of the base as represented by 100%, and the hard particles contain 20–60% of Mo, 0.2–3% of C, 5–40% of Ni, 1–15% of Mn, 0.1–10% of Cr, 4% or less of Si, 40% or less of Co, and a balance including inevitable impurities and Fe, with respect to the total mass of the hard particles as represented by 100%, and wherein the hard particles are dispersed in the base with an area ratio of 10–60%;

(2-e) a wear resistant iron-based sintered alloy which contains 4–30% of Mo, 0.2–3% of C, 1–20% of Ni, 0.5–9% of Mn, 0.05–5% of Cr, 2% or less of Si, and a balance including inevitable impurities and Fe, with respect to the total mass of the sintered alloy as represented by 100%, wherein the base contains 0.2–5% of C, 0.1–10% of Mn, and a balance including inevitable impurities and Fe, with respect to the total mass of the base as represented by 100%, and the hard particles contain 20–60% of Mo, 0.2–3% of C, 5–40% of Ni, 1–15% of Mn, 0.1–10% of Cr, 4% or less of Si, and a balance including inevitable impurities and Fe, with respect to the total mass of the hard particles as represented by 100%, and wherein the hard particles are dispersed in the base with an area ratio of 10–60%;

(2-f) a wear resistant iron-based sintered alloy which contains 4–30% of Mo, 0.2–3% of C, 1–20% of Ni, 0.5–9% of Mn, 0.05–5% of Cr, 24% or less of Co, and a balance including inevitable impurities and Fe, with respect to the total mass of the sintered alloy as represented by 100%, wherein the base contains 0.2–5% of C, 0.1–10% of Mn, and a balance including inevitable impurities and Fe, with respect to the total mass of the base as represented by 100%, and the hard particles contain 20–60% of Mo, 0.2–3% of C, 5–40% of Ni, 1–15% of Mn, 0.1–10% of Cr, 40% or less of Co, and a balance including inevitable impurities and Fe, with respect to the total mass of the hard particles as represented by 100%, and wherein the hard particles are dispersed in the base with an area ratio of 10–60%.

Reasons for Limitations on Compositions of Hard Particles

The reasons for the limitations regarding the composition of the hard particles are as follows. Mo forms carbides of Mo, and thereby improves the hardness and the wear resistance of the hard particles. Furthermore, dissolved Mo and carbides of Mo form a Mo oxide film, to thus provide an improved solid lubrication property. If the amount of Mo contained is less than the above-indicated lower limits, the resulting hard particles exhibit an insufficient solid lubrication property. If the amount of Mo contained exceeds the above-indicated upper limits, the amount of Mo becomes excessive, and the yield in powder production by atomizing or the like is reduced. Therefore, the amount of Mo contained is defined in the above-indicated ranges. In the case of hard particles containing Cr, the amount of Mo contained is reduced in accordance with the content of Cr, and the upper limits of the amount of Mo is accordingly reduced.

C is combined with Mo to form Mo carbides, and thereby improves the hardness and the wear resistance of the hard particles. If the amount of C contained is smaller than the above-indicated lower limits, the wear resistance becomes insufficient. If the amount of C is greater than the above-indicated upper limits, the density of the sintered alloy is reduced. Therefore, the amount of C contained is defined in the ranges as indicated above. In the case of hard particles containing Cr as well as Mo, Cr carbides having a higher hardness than Mo carbides are formed, and therefore the amount of C contained is slightly reduced, that is, the lower limits of the amount of C is reduced to 0.2%.

Ni increases the amount of austenite in the base of the hard particles, and thereby increases the amount of dissolved Mo, thus imparting improved wear resistance. Furthermore, Ni in the hard particles diffuses into the base of the sintered alloy, and increases the amount of austenite in the base, which results in an increased amount of dissolved Mo and improved wear resistance. Since an excessively large amount of Ni merely results in saturation of the above effects, the amount of Ni contained is defined within the ranges as indicated above.

In the aforementioned composition of the hard particles, Mn efficiently diffuses from the hard particles into the base of a sintered alloy during sintering, thus assuring improved adhesion strength between the hard particles and the base. Furthermore, the use of Mn is expected to increase the amount of austenite in the base. Since an excessively large amount of Mn merely results in saturation of the above effects, the amount of Mn contained is defined in the range as indicated above. In the case of hard particles containing Cr, the amount of Mn contained is reduced in accordance with the content of Cr, with the upper limits of the amount of Mn being reduced.

Co increases the amount of austenite in the base of the hard particles and the base of the sintered alloy, and also improves the hardness of the hard particles. Since an excessively large amount of Co merely results in saturation of the above effects, the amount of Co contained is defined in the ranges as indicated above. Further, in view of the aforementioned circumstances, the lower limits of the amount of Co contained may be set to 10% or 15%, and the upper limits thereof may be set to 30% or 35%.

An excessively large amount of an oxide film may be formed on the hard particles due to a high temperature in the environment of use. The excessively large amount of the oxide film may result in peel-off of the oxide film from the hard particles. To suppress the oxidation of the hard particles Cr is added. However, an excessively large amount of Cr makes it considerably unlikely to form an oxide film on the hard particles. Thus, the amount of Cr contained is defined in the ranges as indicated above. Further, in view of the aforementioned circumstances, the lower limits of the amount of Cr contained in the hard particles may be set to 2% or 4%, and the upper limits thereof may be set to 7% or 8%.

Si serves to improve the adhesion strength of the oxide film to the hard particles. However, an excessively large amount of Si may result in an undesirably reduced density of the sintered alloy. Therefore, the amount of Si contained is defined in the ranges as indicated above.

The average particle size of the hard particles may be suitably selected depending upon the use and type of the iron-based sintered alloy, and others. As an example, the average particle size may be controlled to about 20–250 μm, or about 30–200 μm, or about 40–180 μm. However, the average particle size of the hard particles of the present invention is not limited to these ranges.

The hardness of the hard particles should to be greater than the hardness of an object, such as a base of a sintered alloy, with which the hard particles are to be used. The hardness of the hard particles depends on the amount of Mo carbides, but, by way of example, may be generally controlled to about Hv 350–750, or about Hv 450–700. However, the hardness of the hard particles of the present invention is not limited to these ranges.

Method of Producing Wear Resistant Iron-Based Sintered Alloy

In a method of producing a wear resistant iron-based sintered alloy according to the present invention, a mixture is prepared by mixing 10–60% by mass of a powder of one of the above forms (1-a) to (1-f) of hard particles, 0.2–2% by mass of a carbon powder, and an Fe powder or low-alloy steel powder that provides the balance, and the mixture thus obtained is molded to form a green compact. The green compact is then sintered to form a sintered alloy having any one of the compositions indicated above in (2-a) to (2-f).

The above-mentioned hard particles are dispersed in the base of the sintered alloy, so as to provide a hard phase for increased wear resistance of the sintered alloy. If the sintered alloy has a small proportion of the hard particles, its wear resistance is not sufficient. If the proportion of the hard particles is excessively high, on the other hand, the resulting sintered alloy may strongly attack a counterpart, and the capability of holding or retaining the hard particles in the sintered alloy may be reduced. Thus, the amount of the hard particle powder to be mixed is controlled to 10–60% by mass. Typically, a graphite powder may be employed as the carbon powder. C of the carbon powder diffuses into the base of the sintered alloy or the hard particles, to be dissolved or form carbides (Mo carbides, Cr carbides, etc.). Thus, the amount of the carbon powder to be mixed is controlled to 0.2–2%.

The Fe powder or low-alloy steel powder forms a base of the wear resistant iron-based sintered alloy. The above-described method makes it possible to reduce the cost of starting materials. Furthermore, the green compact can be compressed and formed into shape in a desirable manner, to provide a high density, thus assuring a high density of the resulting sintered alloy.

According to the above-described method, alloy elements contained in one of the hard particles and the base diffuse into the other during sintering, thereby to increase the strength of adhesion between the hard particles and the base. In particular, where the hard particles having the composition of the present invention are employed, Mn contained in the hard particles efficiently diffuse into the base, thereby to increase the adhesion strength between the hard particles and the base. This also leads to increased density, increased hardness and improved wear resistance of the resulting sintered alloy.

The Fe powder or low-alloy steel powder forms a base of the wear resistant iron-based sintered alloy as mentioned above. The low-alloy steel powder may be an Fe—C-based powder. For example, a powder having a composition consisting of 0.2–5% of C, and a balance consisting of inevitable impurities and Fe, with respect to the total mass of the low-alloy steel powder as represented by 100%, may be employed.

The sintering temperature may be about 1050–1250° C., or preferably, about 1100–1150° C. The sintering time at such a sintering temperature may be 30–120 minutes, or preferably, 45–90 minutes. The sintering atmosphere is preferably a non-oxidizing atmosphere such as an inert gas atmosphere, or the like. Examples of the non-oxidizing atmosphere include a nitrogen atmosphere, an argon gas atmosphere, and a vacuum.

In the method of producing a wear resistant iron-based sintered alloy according to the present invention, the reasons for limitations on the composition of the hard particles, and preferable ranges of the composition of the hard particles, and the hardness and the average particle size of the hard particles are basically the same as those previously discussed.

Preferred Use

Generally, the valve systems of gas engines using compressed natural gas (CNG) or liquefied petroleum gas (LPG) as fuel include sliding regions having a relatively weak solid lubrication property, as compared with those of valve systems of gasoline engines. One reason this may be the case is because the combustion atmosphere in gas engines has a weaker oxidizing power than that in gasoline engines. Therefore, an oxide film having a solid lubrication property is less likely to be formed in gas engines than in gasoline engines.

In the wear resistant iron-based sintered alloy of the present invention, Mo contained in the hard particles is more likely to form a favorable oxide film at a lower temperature than Cr, and the oxide film thus formed provides a desired solid lubrication property in a low range or medium range of ambient temperature during use, as well as in a high temperature range. Thus, the hard particles have a desired solid lubrication property in addition to required hardness. Accordingly, the wear resistant iron-based sintered alloy of the present invention is suitably employed as a sintered alloy for use in a valve system that includes a valve seat, a valve face, or other component of a gas engine for a motor vehicle or the like using compressed natural gas or liquefied petroleum gas as a fuel. Needless to say, the wear resistant iron-based sintered alloy of the invention may be used for a valve seat, a valve face or other component of a gasoline engine or a diesel engine. It is, however, to be understood that the application of the wear resistant iron-based sintered alloy is not limited to those as indicated above. For example, the wear resistant iron-based sintered alloy may also be used as a sliding member, such as a valve guide, or a turbocharger waste gate valve bush, that is used in a heated region.

Figure 6:
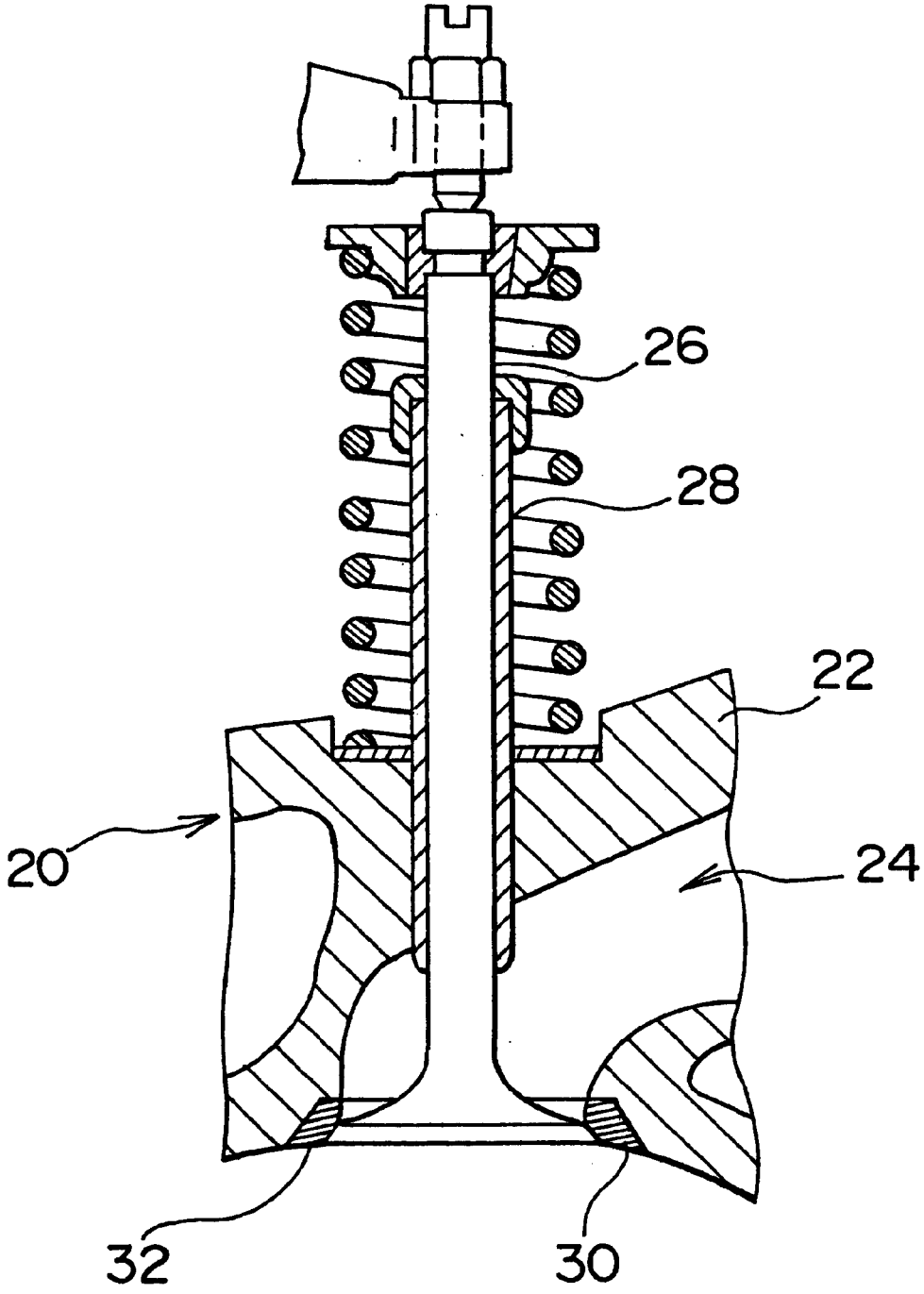
FIG. 6 is a partially cross-sectional view showing a cylinder head that includes a valve seat formed from the sintered alloy of the invention.
Figure 7:
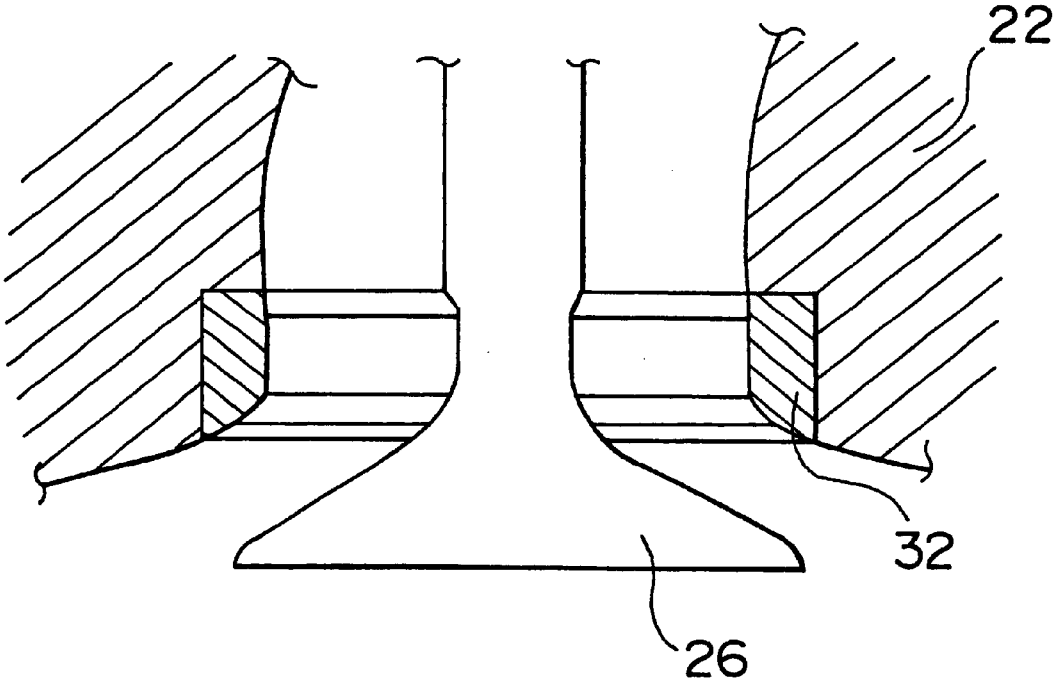
FIG. 7 is a partially cross-sectional view showing in enlargement the cylinder head of FIG. 6.

FIG. 6 and FIG. 7 show a cylinder head 11 of a vehicle engine in which an intake or exhaust valve 26 is mounted. The cylinder head 11 includes a valve seat 32 on which a valve face 32 of the intake/exhaust valve 26 abuts upon closing of the valve 26. The valve seat 32 of the cylinder head 11 is formed from the wear-resistant iron-based sintered alloy of the invention as described above.

EXAMPLES

Examples in which the present invention was embodied and comparative examples will be described based on results of experiments.

Initially, alloy powders having compositions indicated as specimens A to M in TABLE 1 below were produced by gas atomization with the use of an inert gas (nitrogen gas). The alloy powders were then classified into a range of 44 μm to 180 μm, to thus provide hard particle powders. The hard particles having the composition of specimen N were prepared by pulverizing a solidified material (ferromolybdenum) obtained by solidifying a dissolved melt.

TABLE 1

| | Composition of hard particles mass % | | | | | | | | Oxidation Start |
|---|---|---|---|---|---|---|---|---|---|
| | Mo | C | Ni | Mn | Co | Cr | Si | Fe | Temp. EC |
| A | 39 | 1.7 | 20 | 12 | | | | Bal. | 620 |
| B | 40 | 1.8 | 12 | 9 | 25 | | | Bal. | 640 |
| C | 35 | 0.9 | 18 | 12 | | 5 | | Bal. | 650 |
| D | 33 | 0.8 | 10 | 6 | 30 | 5 | 1 | Bal. | 660 |
| E | 15 | 0.9 | 10 | 6 | 30 | 5 | 1.1 | Bal. | 610 |
| F | 40 | 4.5 | 20 | 12 | | | | Bal. | 640 |
| G | 33 | 0.9 | | 7 | 30 | 5 | 1 | Bal. | 630 |
| H | 31 | 0.9 | 11 | | 29 | 5 | 1 | Bal. | 640 |
| I | 32 | 0.8 | 10 | 6 | 30 | 18 | 1 | Bal. | 880 |
| J | 37 | 1.7 | 19 | 12 | | | 5 | Bal. | 660 |
| K | | 1.2 | 0.2 | | Bal. | 29 | 1.3 | 0.3 | 930 |
| L | 28 | 0.07 | 0.3 | | Bal. | 9.5 | 2.2 | 0.4 | 750 |
| M | 25 | 3 | Bal. | | | 20.5 | 1.1 | 17.3 | 900 |
| N | 63 | | | | | | 1.1 | Bal. | 570 |

Note: Bal. = Balance

Specimens A to D are powders of hard particles within the scope of the present invention, and are examples in accordance with the present invention. Specimens E to J are comparative examples, and specimens K to N are known examples. More specifically, specimen E contains Mo in a relatively small amount of 15%, and specimen F contains C in a relatively large amount of 4.5%, while specimen G does not contain Ni. Specimen H does not contain Mn having a good diffusion efficiency, and specimen I contains Cr in a relatively large amount of 18%, while specimen J contains Si in a relatively large amount of 5%. Specimen K is Stellite No. 6, containing neither Mo nor Mn. Specimen L is Triballoy T400, containing no Mn. Specimen M does not contain Mn, and has an Ni group. Specimen N is ferromolybdenum (FeMo), containing neither Ni nor Mn.

The powder of each specimen of hard particles corresponding to the above specimens A through N was heated in the atmosphere and thus oxidized, and the temperature at which the weight of the powder was suddenly increased due to the oxidation was monitored or detected. This temperature is regarded as the oxidation start temperature and is presented in TABLE 1 and shown in FIG. 1, in which the horizontal axis represents the amount of Cr, and the vertical axis represents the oxidation start temperature.

In FIG. 1, 0% in the amount of Cr corresponds to that of specimen A, and 5% in the amount of Cr corresponds to that of specimen C. Furthermore, 9.5% in the amount of Cr corresponds to that of specimen L, and 20.5% in the amount of Cr corresponds to that of specimen M, and 29% in the amount of Cr corresponds to that of specimen K.

As can be understood from FIG. 1, the oxidation start temperature shifts toward a lower temperature as the amount of Cr contained in the hard particles is reduced.

As shown in TABLE 1, the oxidation start temperatures of specimens A to D corresponding to the hard particles of the present invention was in a range of about 610–660° C., which is lower than those of known examples, that is, specimen K (an oxidation start temperature of 930° C., Stellite No. 6, 29% of Cr), specimen L (an oxidation start temperature of 750° C., Triballoy T400, 9.5% of Cr), and others.

TABLE 2

| | Mixing Ratio of Powder of Hard Particles | | | | | | | | | | | | | | | |
|---|---|---|---|---|---|---|---|---|---|---|---|---|---|---|---|---|
| | A | B | C | D | E | F | G | H | I | J | K | L | M | N | Ratio of Graphite | Ratio of Fe Powder |
| Ex. 1 | 40 | | | | | | | | | | | | | | 0.6 | Balance |
| Ex. 2 | | 40 | | | | | | | | | | | | | 0.6 | Balance |
| Ex. 3 | | | 40 | | | | | | | | | | | | 0.6 | Balance |
| Ex. 4 | | | | 40 | | | | | | | | | | | 0.6 | Balance |
| Ex. 5 | | | | 15 | | | | | | | | | | | 0.6 | Balance |
| Ex. 6 | | | | 55 | | | | | | | | | | | 0.6 | Balance |
| Ex. 7 | | | | 40 | | | | | | | | | | | 0.4 | Balance |
| Ex. 8 | | | | 40 | | | | | | | | | | | 1.8 | Balance |
| Com. | | | | | 40 | | | | | | | | | | 0.6 | Balance |
| Ex. 1 | | | | | | | | | | | | | | | | |
| Com. | | | | | | 40 | | | | | | | | | 0.6 | Balance |
| Ex. 2 | | | | | | | | | | | | | | | | |
| Com. | | | | | | | 40 | | | | | | | | 0.6 | Balance |
| Ex. 3 | | | | | | | | | | | | | | | | |
| Com. | | | | | | | | 40 | | | | | | | 0.6 | Balance |
| Ex. 4 | | | | | | | | | | | | | | | | |
| Com. | | | | | | | | | 40 | | | | | | 0.6 | Balance |
| Ex. 5 | | | | | | | | | | | | | | | | |
| Com. | | | | | | | | | | 40 | | | | | 0.6 | Balance |
| Ex. 6 | | | | | | | | | | | | | | | | |
| Com. | | | | | | | | | | | 40 | | | | 0.6 | Balance |
| Ex. 7 | | | | | | | | | | | | | | | | |
| Com. | | | | | | | | | | | | 40 | | | 0.6 | Balance |
| Ex. 8 | | | | | | | | | | | | | | | | |
| Com. | | | | | | | | | | | | | 40 | | 0.6 | Balance |
| Ex. 9 | | | | | | | | | | | | | | | | |
| Com. | | | | | | | | | | | | | | 40 | 0.6 | Balance |
| Ex. 10 | | | | | | | | | | | | | | | | |

TABLE 2-continued

| | Mixing Ratio of Powder of Hard Particles | | | | | | | | | | | | | | | |
|---|---|---|---|---|---|---|---|---|---|---|---|---|---|---|---|---|
| | A | B | C | D | E | F | G | H | I | J | K | L | M | N | Ratio of Graphite | Ratio of Fe Powder |
| Com. Ex. 14 | | | | 5 | | | | | | | | | | | 0.6 | Balance |
| Com. Ex. 15 | | | | 70 | | | | | | | | | | | 0.6 | Balance |

TABLE 3

| | Composition of Sintered Alloy as a whole (mass %) | | | | | | | | | | Type of Hard | Mixing Ratio of Hard Particle |
|---|---|---|---|---|---|---|---|---|---|---|---|---|
| | Mo | C | Ni | Co | Cr | Si | Pb | W | Ca | Fe | Particle | (Mass %) |
| Com. Ex. 11[a] | 3.5 | 1 | | 10 | 1.1 | 0.35 | 16 | | | Bal. | L | 15 |
| Com. Ex.12[b] | 11.5 | 1 | 6 | 24 | 5 | 1 | | | | Bal. | L | 40 |
| Com. Ex.13[c] | 6.5 | 0.4 | 9.5 | 9.5 | | | | 1 | 1 | | N | 10 |

[a]= Impregnated with molten lead;
[b]= Molded twice, Sintered twice;
[c]= Sintered/forged;
Bal. = balance Next, mixed powders to be used as materials for sintered alloys were formed by mixing (by means of a mixing machine) a selected one of the hard particle powders corresponding to specimens A to N, a graphite powder, and a pure Fe powder, in the proportions as indicated in Table 2. As shown in TABLE 2, in most of the examples, the proportion of the hard particle powder was 40%, and the proportion of the graphite powder was 0.6%. In Example 5, the proportion of the hard particle powder was relatively small, i.e., 15%. In Example 6, the proportion of the hard particle powder was relatively large, i.e., 55%. In Example 7, the proportion of the graphite powder was relatively small, i.e., 0.4%. In Example 8, the proportion of the graphite powder was relatively large, i.e., 1.8%.

Using forming dies, the mixed powder of each example prepared as described above was compressed and molded into a ring-shaped test piece with a pressurizing force of $78.4\times10^7$ Pa (8 tonf/cm$^2$), thereby to form a green compact. The test piece was shaped like a valve seat.

Thereafter, each green compact was sintered in an inert atmosphere (nitrogen gas atmosphere) at 1120° C. for 60 minutes, so as to form a sintered alloy (valve seat) corresponding to the test piece.

With regard to Comparative Examples 1 to 10 and Comparative Examples 14 and 15, ring-shaped test pieces were molded by compression, and sintered alloys (valve seats) corresponding to the test pieces were produced.

Furthermore, under the conditions as indicated in TABLE 3, test pieces corresponding to Comparative Examples 11 to 13 were also formed to provide sintered alloys (valve seats). As indicated in TABLE 3, in Comparative Example 11, specimen L (Triballoy T400) was used as hard particles, and a green compact formed by compression-molding a mixed powder containing 15% of specimen L was sintered, while pores of the green compact were impregnated with molten lead, for increased density of the sintered alloy. In Comparative Example 12, specimen L (Triballoy T400) was used as hard particles, and 40% of specimen L was mixed with other elements. In order to increase the density and wear resistance of the sintered alloy in Comparative Example 12, compression-molding was performed twice to form a green compact, and the green compact was sintered twice. In Comparative Example 13, specimen N (ferromolybdenum) was used as hard particles, and a green compact was formed by compression from a mixed powder containing 10% of specimen N. In order to increase the density and the wear resistance, the green compact was sintered and forged. Each of the compositions shown in TABLE 3 is the composition of the corresponding sintered alloy as a whole.

Figure 2:
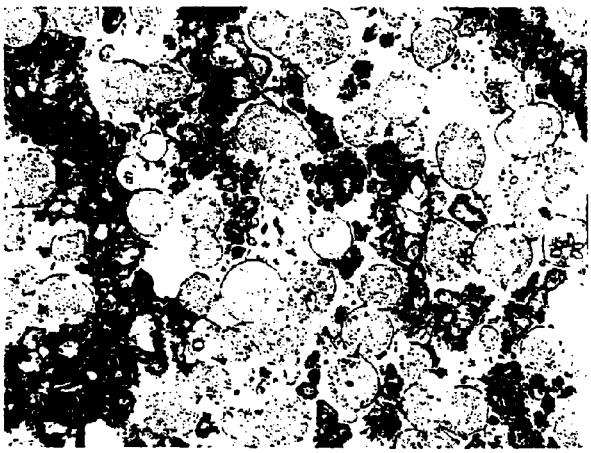
FIG. 2 is an optical microscopic photograph (magnification: 100 times) showing Example 1 of the present invention.

FIG. 2 shows an optical microscopic photograph (magnification: 100 times) of a sintered alloy corresponding to Example 1. In the image, pearlite (blackish island-like hard particles in the shape of round particles) is dispersed in austenite (white base of the sintered alloy) and approximately no pores are observed. The proportion of the hard particles is about 20–50% in terms of the area ratio with respect to the total area of the sintered alloy (base+hard particles) as represented by 100%.

Figure 3:
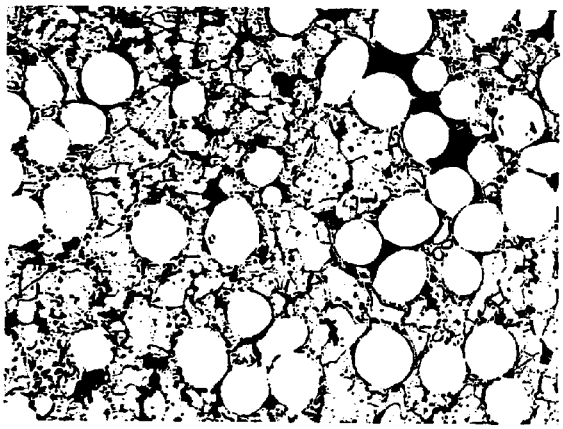
FIG. 3 is an optical microscopic photograph (magnification: 100 times) showing Comparative Example 8.

FIG. 3 shows an optical microscopic photograph (magnification: 100 times) of a sintered alloy corresponding to Comparative Example 8. In the image, Triballoy T400 (white hard particles in the shape of round particles) is dispersed in the base of the sintered alloy, and a considerable number of pores (black portions between adjacent hard particles) are observed between adjacent hard particles.

Figure 4:
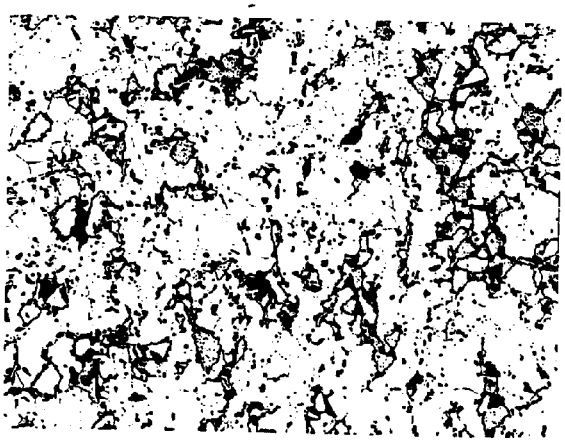
FIG. 4 is an optical microscopic photograph (magnification: 100 times) showing Comparative Example 10.

FIG. 4 shows an optical microscopic photograph (magnification: 100 times) corresponding to Comparative Example 10. In the image, ferromolybdenum (numerous blackish hard particles) is dispersed in the base of the sintered alloy, and a considerable number of pores (black portions between adjacent hard particles) are observed between adjacent hard particles.

To ascertain the state of junction at which the hard particles are joined to the base of the sintered alloy, EPMA analysis of each test piece was conducted to measure the composition of the sintered alloy as a whole, the composition of the hard particles, and the composition of the base and the results of the analysis are shown in TABLE 4 below. In TABLE 4, the whole composition means a composition of a sintered alloy when the total mass of the sintered alloy is expressed as 100% by mass. The hard-particle composition means a composition of hard particles when the total mass of the hard particles is expressed as 100% by mass. The base composition means a composition of a base when the total mass of the base is expressed as 100% by mass.

Although the Fe powder as a starting material for forming the base of the sintered alloy does not contain Mn, Mo, and Co in each example, the analyzed composition of the base of the sintered alloy of each example contains Mn, Mo, and Co as shown in Table 4. This may be because Mn, Mo and Co thermally diffuses from the hard particles into the base during sintering. In particular, it will be understood from TABLE 4 that the amount of Mn contained in the base is considerably high, that is, exceeds 1% in most Examples.

Although the Fe powder as a starting material for forming the base did not contain Mn, the amount of Mn contained in the base of the sintered alloy was considerably high. More specifically, the amount of Mn contained in the base of the sintered alloy was 2.3% in Example 1, 2.3% in Example 2, 2.3% in Example 3, 1.3% in Example 4, 1.8% in Example 6, 1.3% in Example 7, and 1.3% in Example 8. In Example 5, the amount of Mn contained in the base of the sintered alloy was 0.53% due to the relatively small (about 37%= 15/40 as compared with Examples 1 to 4) amount of hard particle powder added.

The increase in the amount of element(s) diffused from the hard particles into the base may lead to improved capability of retaining the hard particles in the base, improved density and hardness of the sintered alloy, and a reduced amount of wear of the sintered alloy. In the Examples of the present invention, however, neither the amount of Ni nor that of Co in the base of the sintered alloy exceeded 1%, except for Example 6, in which the proportion of the hard particle powder added was high.

The values of α (the amount of Mn in the base of the sintered alloy/the amount of Mn in the hard particles dis-

TABLE 4

| | | Composition (mass %) | | | | | | | |
|---|---|---|---|---|---|---|---|---|---|
| | | Mo | C | Ni | Mn | Co | Cr | Si | Fe |
| Ex. 1 | Whole Composition | 15.6 | 1.25 | 8 | 4.8 | | | | 70.4 |
| | Base Composition | 0.67 | 0.95 | 0.67 | 2.3 | | | | 95.4 |
| | Hard-particle Composition | 38 | 1.7 | 19 | 8.5 | | | | 32.8 |
| Ex. 2 | Whole Composition | 16 | 1.3 | 4.8 | 3.6 | 10 | | | 64.3 |
| | Base Composition | 0.67 | 0.97 | 0.33 | 2.3 | 0.67 | | | 95 |
| | Hard-particle Composition | 39 | 1.8 | 11.5 | 5.5 | 24 | | | 18.2 |
| Ex. 3 | Whole Composition | 14 | 0.93 | 7.2 | 4.8 | | 2 | | 71.1 |
| | Base Composition | 0.67 | 0.95 | 0.33 | 2.3 | | 0.13 | | 95.6 |
| | Hard-particle Composition | 34 | 0.9 | 17.5 | 8.5 | | 4.8 | | 34.3 |
| Ex. 4 | Whole Composition | 13.2 | 0.9 | 4 | 2.4 | 12 | 2 | 0.4 | 65.1 |
| | Base Composition | 0.67 | 0.97 | 0.33 | 1.3 | 0.33 | 0.2 | 0.03 | 96.1 |
| | Hard-particle Composition | 32 | 0.8 | 9.5 | 4 | 29.5 | 4.7 | 0.95 | 18.6 |
| Ex. 5 | Whole Composition | 4.95 | 0.7 | 1.5 | 0.9 | 4.5 | 0.75 | 0.15 | 86.6 |
| | Base Composition | 0.18 | 0.68 | 0.09 | 0.53 | 0.18 | 0.04 | 0.01 | 98.3 |
| | Hard-particle Composition | 32 | 0.8 | 9.5 | 3 | 29 | 4.8 | 0.95 | 20 |
| Ex. 6 | Whole Composition | 18.15 | 1 | 5.5 | 3.3 | 16.5 | 2.75 | 0.55 | 52.3 |
| | Base Composition | 1.2 | 1.2 | 0.61 | 1.8 | 1.2 | 0.24 | 0.06 | 93.6 |
| | Hard-particle Composition | 32 | 0.8 | 9.5 | 4.5 | 29 | 4.8 | 0.95 | 18.5 |
| Ex. 7 | Whole Composition | 13.2 | 0.7 | 4 | 2.4 | 12 | 2 | 0.4 | 65.3 |
| | Base Composition | 0.67 | 0.67 | 0.33 | 1.3 | 0.67 | 0.2 | 0.03 | 96.1 |
| | Hard-particle Composition | 32 | 0.75 | 9.5 | 4 | 29 | 4.7 | 0.95 | 19.1 |
| Ex. 8 | Whole Composition | 13.2 | 2 | 4 | 2.4 | 12 | 2 | 0.4 | 64 |
| | Base Composition | 0.67 | 2.3 | 0.33 | 1.3 | 0.33 | 0.2 | 0.03 | 94.8 |
| | Hard-particle Composition | 32 | 1.6 | 9.5 | 4 | 29.5 | 4.7 | 0.95 | 17.8 |
| Com. Ex. 4 | Whole Composition | 12.4 | 0.9 | 4.4 | | 11.6 | 2 | 0.4 | 68.3 |
| | Base Composition | 0.67 | 0.9 | 0.33 | | 0.67 | 0.13 | 0.03 | 97.3 |
| | Hard-particle Composition | 30 | 0.9 | 10.5 | | 28 | 4.8 | 0.95 | 24.9 |
| Com. Ex. 8 | Whole Composition | 11.2 | 0.6 | 0.1 | | 23.8 | 3.8 | 0.88 | 59.6 |
| | Base Composition | 0.67 | 0.53 | 0.03 | | 0.33 | 0.33 | 0.13 | 98 |
| | Hard-particle Composition | 27 | 0.7 | 0.2 | | 59 | 9 | 2 | 2.1 |
| Com. Ex. 10 | Whole Composition | 25.2 | 0.6 | | | | | 0.44 | 73.8 |
| | Base Composition | 0.67 | 0.53 | | | | | 0.03 | 98.8 |
| | Hard-particle Composition | 62 | 0.7 | | | | | 1.05 | 36.3 |

persed in the base) were, in terms of percentage by mass, 2.3/8.5≈0.270 in Example 1, 2.3/5.5≈0.418 in Example 2, 2.3/8.5≈0.270 in Example 3, 1.3/4≈0.325 in Example 4, 0.53/3≈0.176 in Example 5, 1.8/4.5≈0.4 in Example 6, 1.3/4≈0.325 in Example 7, and 1.3/4≈0.325 in Example 8. Thus, the value $\alpha$ was within the range of about 0.10 to about 0.7, and, in particular, within the range of about 0.15 to about 0.45, which indicates that Mn has a high diffusion efficiency.

With regard to diffusion of molybdenum, the value of $\beta$ (the amount of Mo contained in the base/the amount of Mo contained in the hard particles) was 0.67/38≈0.017 in Example 1, 0.67/39≈0.017 in Example 2, 0.67/34≈0.019 in Example 3, 0.67/32≈0.020 in Example 4, $0.18/32 \approx 5.6 \times 10^{-3} = 0.0056$ in Example 5, 1.2/32≈0.0375 in Example 6, 0.67/32≈0.020 in Example 7, and 0.67/32≈0.020 in Example 8. Thus, the value $\beta$, representing the diffusion efficiency of Mo, was within the range of about 0.005 to about 0.04, and was one order of magnitude smaller than the value $\alpha$ representing the diffusion efficiency of Mn. This also clearly indicates a high diffusion efficiency of manganese (Mn).

To further verify the above-described points, the density and the hardness of the sintered alloy according to each test piece were measured and the results are shown in TABLE 5. The hardness of the sintered alloy was measured to determine a Vickers hardness (load: 10 kgf).

TABLE 5

| | Iron-based Sintered Alloy | | | |
|---|---|---|---|---|
| | Density | Hardness | Wear Amount (mm) | |
| | (g/cm$^3$) | (Hv (10 kgf)) | 200° C. | 300° C. |
| Example 1 | 7.08 | 195 | 0.02 | 0.045 |
| Example 2 | 7.1 | 210 | 0.012 | 0.035 |
| Example 3 | 7.1 | 205 | 0.04 | 0.025 |
| Example 4 | 7.15 | 222 | 0.035 | 0.015 |
| Example 5 | 7.17 | 200 | 0.045 | 0.03 |
| Example 6 | 7.09 | 185 | 0.04 | 0.03 |
| Example 7 | 7.05 | 175 | 0.045 | 0.035 |
| Example 8 | 7.11 | 270 | 0.05 | 0.045 |
| Com. Ex. 1 | 7.18 | 195 | 0.07 | 0.06 |
| Com. Ex. 2 | 6.73 | 172 | 0.1 | 0.08 |
| Com. Ex. 3 | 7.11 | 210 | 0.08 | 0.07 |
| Com. Ex. 4 | 6.88 | 145 | 0.1 | 0.08 |
| Com. Ex. 5 | 7.08 | 190 | 0.1 | 0.08 |
| Com. Ex. 6 | 6.98 | 190 | 0.09 | 0.07 |
| Com. Ex. 7 | 6.9 | 135 | 0.2 | 0.15 |
| Com. Ex. 8 | 6.97 | 93 | 0.1 | 0.08 |
| Com. Ex. 9 | 6.95 | 185 | 0.18 | 0.14 |
| Com. Ex. 10 | 6.96 | 135 | 0.12 | 0.13 |
| Com. Ex. 14 | 6.97 | 170 | 0.09 | 0.06 |
| Com. Ex. 15 | 6.95 | 135 | 0.1 | 0.08 |

Figure 5:
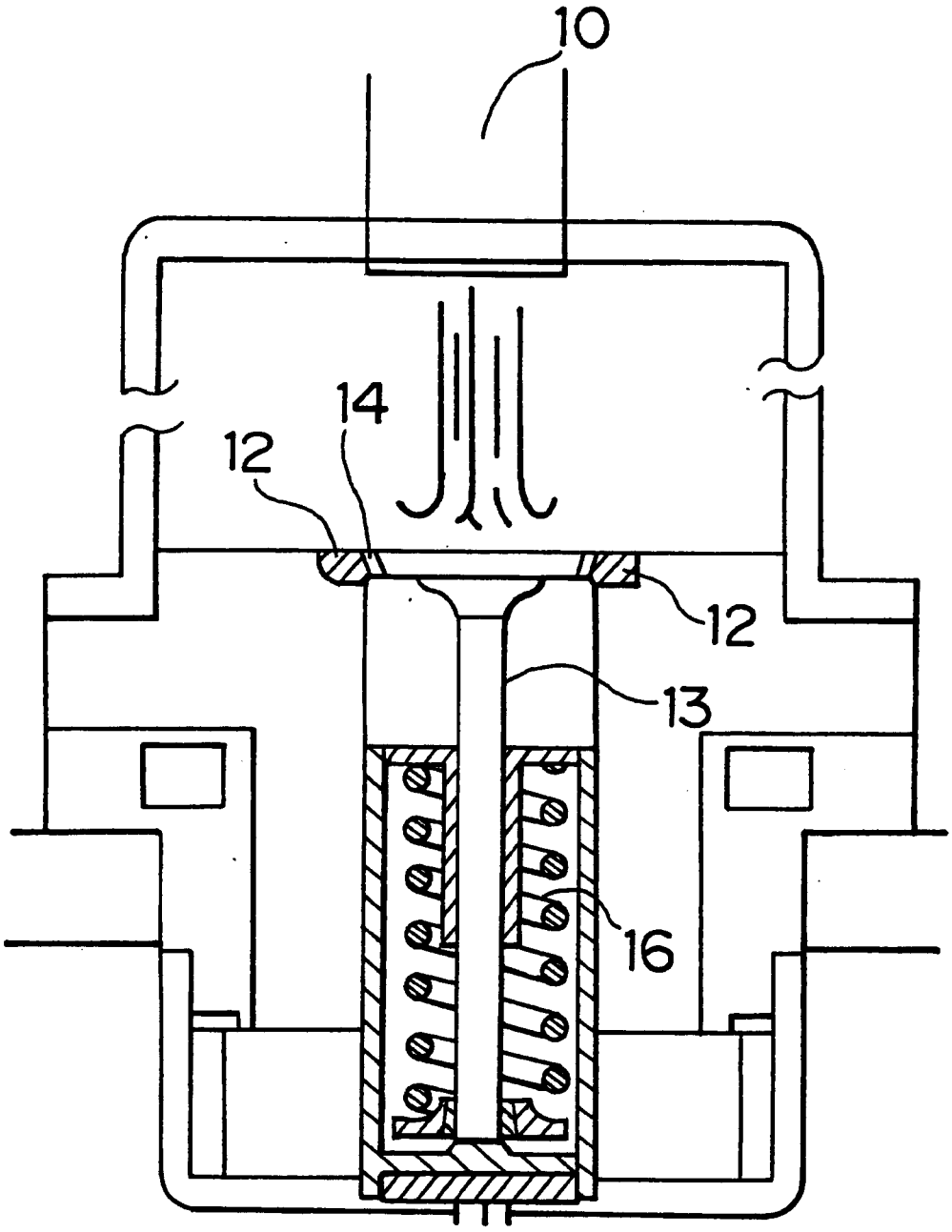
FIG. 5 is a cross-sectional view of an apparatus with which a durability test is conducted.

Next, using a test machine 1 as shown in FIG. 5, a wear test was conducted to evaluate the wear resistance of the sintered alloy. In the wear test, a propane gas burner 10 was used as a heating source to provide a propane gas combustion atmosphere around sliding portions between a ring-shaped valve seat 12 and a valve face 14 of a valve 13. The ring-shaped valve seat 12 was a test piece formed from a sintered alloy as described above. The valve face 14 was formed by subjecting SUH11 to a soft nitriding process. An 8-hour wear test was conducted in the following manner; while the temperature of the valve seat 12 was controlled to 200° C., the valve seat 12 and the valve face 14 were caused to contact at a rate of 2000 times per minute with a load of 18 kgf. The load was applied at the time of contact between the valve seat 12 and the valve face 14 by a spring 16. A similar wear test was also conducted with the temperature of the valve seat 12 being controlled to 300° C. The amounts of wear of each test piece at the test temperatures of 200° C. and 300° C. are shown in TABLE 5.

As shown in TABLE 5, the density of the sintered alloy of each of Examples 1 to 8 was at least 7 g/cm$^3$ or higher. The hardness of the sintered alloy of each of Examples 1 to 8 was at least Hv 175 or greater. The amount of wear of the sintered alloys of Examples 1 to 8 was small, i.e., 0.05 mm or less.

In contrast, the sintered alloy of each of Comparative Examples 1 to 15 generally had a lower density and a lower hardness than the inventive examples. In addition, Comparative Examples 1 to 15 suffered a large amount of wear, in a majority of examples, twice as much wear or more, than the inventive examples. In particular, the sintered alloy of Comparative Example 3, while having a high density and a large hardness, suffered large amounts of wear, namely, 0.08 mm at the test temperature of 200° C. and 0.07 mm at the test temperature of 300° C., which indicates poor wear resistance of the sintered alloy.

Next, the valve seat 12 of each of Examples 1 and 4 was mounted in an engine. The engine was a 2700 cc-displacement engine using LPG as a fuel and was used to conduct a 300-hour durability test. Similar durability tests were also conducted with respect to valve seats 12 of Comparative Examples 11 to 13. Then, an amount of protrusion (mm) of a valve 13 and an amount of increase (mm) in the width of contact of the valve seat 12 (mm) were measured with respect to each valve system. The measurement was conducted on both the intake side and the exhaust side of the engine. The valve face on the intake side was obtained by performing a soft nitriding process on SUH11, and the valve face on the exhaust side was obtained by depositing Mo-based alloy on SUH11.

The amount of valve protrusion means the displacement of the valve position toward the outside of the engine upon closing of the valve, which is caused by wear of the valve seat 12 and wear of the valve face 14. The amount of increase in the width of contact of the valve seat 12 means an amount of increase in the width of a contact portion of the valve seat 12 with the valve face 14 due to wear of the valve seat 12 caused by contact of the valve seat 12 with the valve face 14. Measurement results are shown in TABLE 6.

TABLE 6

| | Intake Side | | Exhaust Side | |
|---|---|---|---|---|
| | Valve Protrusion (mm) | Increase in Contact Width of Seat (mm) | Valve Protrusion (mm) | Increase in Contact Width of Seat (mm) |
| Example 1 | 0.02 | 0.07 | 0.05 | 0.2 |
| Example 2 | 0.04 | 0.18 | 0.03 | 0.12 |
| Com. Ex. 11 | 0.2 | 0.75 | 0.1 | 0.4 |
| Com. Ex. 12 | 0.2 | 0.75 | 0.1 | 0.4 |
| Com. Ex. 13 | 0.15 | 0.55 | 0.15 | 0.55 |

As shown in TABLE 6, Example 1 and Example 2 showed significantly reduced amounts of valve protrusion and significantly reduced amounts of increase in the width of contact of the valve seat on both the intake side and the exhaust side in contrast to Comparative Examples 11 to 13. The data indicates that the wear resistance of the inventive samples was superior to the comparative examples.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A wear-resistant iron-based sintered alloy comprising:

a base; and a plurality of particles, wherein the wear resistant iron-based sintered alloy includes, in percentage by mass and with respect to the total mass of the iron-based sintered alloy as represented by 100%, 4 to 30% of Mo, 0.2 to 3% of C, 1 to 20% of Ni, 0.5 to 12% of Mn, a balance of Fe, and impurities;

wherein the base, in percentage by mass and with respect to the total mass of the base as represented by 100%, comprises 0.2 to 5% of C, 0.1 to 12% of Mn, a balance of Fe, and impurities;

wherein the plurality of particles, in percentage by mass and with respect to the total mass of the plurality of particles represented by 100%, comprises 20 to 70% of Mo, 0.5 to 3% of C, 4 to 40% of Ni, 1 to 20% of Mn, a balance of Fe, and impurities; and wherein the particles are dispersed in the base with an area ratio of 0.10 to 0.60.

2. The wear resistant iron-based sintered alloy as defined in claim 1, further comprising:

24% or less of Co, in percentage by mass and with respect to the total mass of the sintered alloy, and wherein the plurality of particles, in percentage by mass and with respect to the total mass of the plurality of particles as represented by 100%, further comprises 40% or less of Co.

3. The wear-resistant iron-based sintered alloy as defined in claim 1, wherein a value $\alpha$, which is a ratio of an amount of Mn contained in the base of the sintered alloy in percentage by mass to an amount of Mn contained in the plurality of particles dispersed in the base in percentage by mass, is within a range of 0.05 to 1.0.

4. The wear-resistant iron-based sintered alloy as defined in claim 2, wherein a value $\alpha$, which is a ratio of an amount of Mn contained in the base of the sintered alloy in percentage by mass to an amount of Mn contained in the plurality of particles dispersed in the base in percentage by mass, is within a range of 0.05 to 1.0.

5. A valve seat comprising the alloy of claim 1.

6. A cylinder head comprising the valve seat of claim 5.

7. An internal combustion device comprising the cylinder head of claim 6 and a source of a combustible fuel in fluid communication with the cylinder head, wherein the fuel is selected from the group consisting of compressed natural gas and liquefied petroleum gas.

8. A wear-resistant iron-based sintered alloy comprising:

a base; and a plurality of particles, wherein the wear resistant iron-based sintered alloy, in percentage by mass and with respect to the total mass of the iron-based sintered alloy as represented by 100%, includes 4 to 30% of Mo, 0.2 to 3% of C, 1 to 20% of Ni, 0.5 to 9% of Mn, 0.05 to 5% of Cr, a balance of Fe, and impurities;

wherein the base, in percentage by mass and with respect to the total mass of the base as represented by 100%, comprises 0.2 to 5% of C, 0.1 to 10% of Mn, a balance of Fe, and impurities;

wherein the plurality of particles, in percentage by mass and with respect to the total mass of the plurality of particles represented by 100%, comprises 20 to 60% of Mo, 0.2 to 3% of C, 5 to 40% of Ni, 1 to 15% of Mn, 0.1 to 10% of Cr, a balance of Fe, and impurities; and wherein the hard particles are dispersed in the base with an area ratio of 0.10 to 0.60.

9. The wear-resistant iron-based sintered alloy as defined in claim 8, further comprising:

at least one of 24% or less of Co and 2% or less of Si, in percentage by mass and with respect to the total mass of the sintered alloy, and wherein the plurality of particles, in percentage by mass and with respect to the total mass of the plurality of particles as represented by 100%, further comprises at least one of 40% or less of Co and 4% or less of Si.

10. The wear-resistant iron-based sintered alloy as defined in claim 8, wherein a value $\alpha$, which is a ratio of an amount of Mn contained in the base of the sintered alloy in percentage by mass to an amount of Mn contained in the plurality of particles dispersed in the base in percentage by mass, is within a range of 0.05 to 1.0.

11. The wear-resistant iron-based sintered alloy as defined in claim 9, wherein a value $\alpha$, which is a ratio of an amount of Mn contained in the base of the sintered alloy in percentage by mass to an amount of Mn contained in the plurality of particles dispersed in the base in percentage by mass, is within a range of 0.05 to 1.0.

12. A valve seat comprising the alloy of claim 8.

13. A cylinder head comprising the valve seat of claim 12.

14. An internal combustion device comprising the cylinder head of claim 13 and a source of a combustible fuel in fluid communication with the cylinder head, wherein the fuel is selected from the group consisting of compressed natural gas and liquefied petroleum gas.

15. A method of producing a wear resistant iron-based sintered alloy, comprising the steps of:

preparing a mixture by mixing, in percentage by mass, an iron powder, 0.2 to 2% of a carbon powder, and 10 to 60% of a powder of a plurality of particles, the plurality of particles comprising 20 to 70% of Mo, 0.5 to 3% of C, 5 to 40% of Ni, 1 to 20% of Mn, a balance of Fe, and impurities;

molding said mixture to form a green compact; and sintering the green compact so as to form a wear resistant iron-based sintered alloy.

16. The method of producing a wear resistant iron-based sintered alloy as defined in claim 15, wherein the sintered alloy formed comprises, in percentage by mass and with respect to the total mass of the iron-based sintered alloy as represented by 100%, 4 to 30% of Mo, 0.2 to 3% of C, 1 to 20% of Ni, 0.5 to 12% of Mn, a balance of Fe, and impurities.

17. The method of producing the wear resistant iron-based sintered alloy as defined in claim 15, wherein the iron powder used in the step preparing the mixture is a pure iron powder.

18. The method of producing the wear resistant iron-based sintered alloy as defined in claim 15, wherein the iron powder used in the step preparing the mixture is a low alloy steel powder.

19. The method of producing the wear resistant iron-based sintered alloy as defined in claim 15, wherein the plurality of particles further comprise 40% or less of Co.

20. The method of producing a wear resistant iron-based sintered alloy as defined in claim 19, wherein the sintered alloy formed comprises, in percentage by mass and with respect to the total mass of the iron-based sintered alloy as represented by 100%, 4 to 30% of Mo, 0.2 to 3% of C, 1 to 20% of Ni, 0.5 to 12% of Mn, 24% or less of Co, a balance of Fe, and impurities.

21. The method of producing the wear resistant iron-based sintered alloy as defined in claim 19, wherein the iron powder used in the step preparing the mixture is a pure iron powder.

22. The method of producing the wear resistant iron-based sintered alloy as defined in claim 19, wherein the iron powder used in the step preparing the mixture is a low alloy steel powder.

23. A method of producing a wear resistant iron-based sintered alloy, comprising the steps of:

preparing a mixture by mixing, in percentage by mass, an iron powder, 0.2 to 2% of a carbon powder, and 10 to 60% of a powder of a plurality of particles, the plurality of particles comprising 20 to 60% of Mo, 0.2 to 3% of C, 5 to 40% of Ni, 1 to 15% of Mn, 0.1 to 10% of Cr, a balance of Fe, and impurities;

molding said mixture to form a green compact; and sintering the green compact so as to form a wear resistant iron-based sintered alloy.

24. The method of producing a wear resistant iron-based sintered alloy as defined in claim 23, wherein the sintered alloy formed comprises, in percentage by mass and with respect to the total mass of the iron-based sintered alloy as represented by 100%, 4 to 30% of Mo, 0.2 to 3% of C, 1 to 20% of Ni, 0.5 to 9% of Mn, 0.05 to 5% of Cr, a balance of Fe, and impurities.

25. The method of producing the wear resistant iron-based sintered alloy as defined in claim 23, wherein the iron powder used in the step preparing the mixture is a pure iron powder.

26. The method of producing the wear resistant iron-based sintered alloy as defined in claim 23, wherein the iron powder used in the step preparing the mixture is a low alloy steel powder.

27. The method of producing the wear resistant iron-based sintered alloy as defined in claim 23, wherein the plurality of particles further comprise at least one of 40% or less of Co and 4% or less of Si.

28. The method of producing a wear resistant iron-based sintered alloy as defined in claim 27, wherein the sintered alloy formed comprises, in percentage by mass and with respect to the total mass of the iron-based sintered alloy as represented by 100%, 4 to 30% of Mo, 0.2 to 3% of C, 1 to 20% of Ni, 0.5 to 9% of Mn, 0.05 to 5% of Cr, at least one of 24% or less of Co and 2% or less of Si, a balance of Fe, and impurities.

29. The method of producing the wear resistant iron-based sintered alloy as defined in claim 27, wherein the iron powder used in the step preparing the mixture is a pure iron powder.

30. The method of producing the wear resistant iron-based sintered alloy as defined in claim 27, wherein the iron powder used in the step preparing the mixture is a low alloy steel powder.

31. A sinterable Fe-based powder mixture which includes a Mn-containing particle wherein the Mn-containing particle is present in an amount effective to provide improved adhesion between the Mn-containing particle and an iron-based powder, the Mn-containing particle comprising in percentage by mass:

20 to 70% of Mo;

0.5 to 3% of C;

5 to 40% of Ni;

1 to 20% of Mn;

a balance of Fe; and impurities.

32. The sinterable Fe-based powder mixture as defined in claim 31, wherein the Mn-containing particle further comprises 40% or less of Co.

33. A sinterable Fe-based powder mixture which includes a Mn-containing particle wherein the Mn-containing particle is present in an amount effective to provide improved adhesion between the Mn-containing particle and an iron-based powder, the Mn-containing particle comprising in percentage by mass:

20 to 60% of Mo;

0.2 to 3% of C;

5 to 40% of Ni;

1 to 15% of Mn;

0.1 to 10% of Cr;

a balance of Fe; and impurities.

34. The sinterable Fe-based powder mixture as defined in claim 33, wherein the Mn-containing particle further comprises at least one of 40% or less of Co and 4% or less of Si.

35. A sinterable mixture comprising, in percentage by mass:

an iron powder;

0.2 to 2% of a carbon powder; and 10 to 60% of a powder including a particle having, in percentage by mass, 20 to 70% of Mo, 0.5 to 3% of C, 5 to 40% of Ni, 1 to 20% of Mn, a balance of Fe, and impurities.

36. The sinterable mixture as defined in claim 35, wherein the particle further comprises 40% or less of Co.

37. A sinterable mixture comprising, in percentage by mass:

an iron powder 0.2 to 2% of a carbon powder; and 10 to 60% of a powder including a particle having, in percentage by mass, 20 to 70% of Mo, 0.5 to 3% of C, 5 to 40% of Ni, 1 to 20% of Mn, 10 to 40% Co, a balance of Fe, and impurities.

38. A sinterable mixture comprising, in percentage by mass:

an iron powder 0.2 to 2% of a carbon powder; and 10 to 60% of a powder including a particle having, in percentage by mass, 20 to 60% of Mo, 0.2 to 3% of C, 5 to 40% of Ni, 1 to 15% of Mn, 0.1 to 10% of Cr, a balance of Fe, and impurities.

39. The sinterable mixture as defined in claim 38, wherein the particle further comprises at least one of 40% or less of Co and 4% or less of Si.

* * * * *